US006143944A

United States Patent [19]

Hash et al.

[11] Patent Number: 6,143,944

[45] Date of Patent: Nov. 7, 2000

[54] CONSOLIDATION PROCESS FOR PRODUCING CERAMIC WASTE FORMS

[75] Inventors: Harry C. Hash, Joliet; Mark C. Hash, Shorewood, both of Ill.

[73] Assignee: The United States of America as represented by the United States Department of Energy, Washington, D.C.

[21] Appl. No.: 09/121,974

[22] Filed: Jul. 24, 1998

[51] Int. Cl.[7] ..... G21F 9/34

[52] U.S. Cl. ..... 588/15; 588/18; 264/0.5; 976/DIG. 385

[58] Field of Search ..... 588/15, 18; 976/DIG. 385; 264/0.5; 250/506.1

[56] References Cited

U.S. PATENT DOCUMENTS

| | | | |
|---|---|---|---|
| 4,460,500 | 7/1984 | Hultgren | 252/628 |
| 5,613,240 | 3/1997 | Lewis et al. | 588/11 |

FOREIGN PATENT DOCUMENTS

| | | |
|---|---|---|
| 2388379 | 4/1977 | France . |
| 63151396 | 6/1988 | Japan . |

*Primary Examiner*—Steven P. Griffin
*Assistant Examiner*—Elin A Warn
*Attorney, Agent, or Firm*—Mark F. LaMarre; Mark P. Dvorscak; William R. Moser

[57] ABSTRACT

A process for the consolidation and containment of solid or semisolid hazardous waste, which process comprises closing an end of a circular hollow cylinder, filling the cylinder with the hazardous waste, and then cold working the cylinder to reduce its diameter while simultaneously compacting the waste. The open end of the cylinder can be sealed prior to or after the cold working process. The preferred method of cold working is to draw the sealed cylinder containing the hazardous waste through a plurality of dies to simultaneously reduce the diameter of the tube while compacting the waste. This process provides a quick continuous process for consolidating hazardous waste, including radioactive waste.

19 Claims, 5 Drawing Sheets

CONSOLIDATION PROCESS FOR PRODUCING CERAMIC WASTE FORMS

STATEMENT REGARDING FEDERALLY SPONSORED RESEARCH OR DEVELOPMENT

The United States Government has rights in this invention pursuant to Contract No. W-31-109-Eng-38 between the U.S. Department of Energy and the University of Chicago representing Argonne National Laboratory.

BACKGROUND OF THE INVENTION

1. Field of the Invention

This invention relates to a process for containing solid wastes. More particularly, this invention relates to a novel process for containing, compacting, and storing solidified radioactive waste including a mixture of crystalline phase of a zeolite with an absorbed metal chloride salt and a glass phase.

2. Description of Related Art

Hazardous wastes are produced by a number of industrial processes, such as chemical, biological, and nuclear processes. The wastes may be in the form of gases, liquids, or solids. The proper disposal of hazardous waste is of considerable importance to industry, due to environmental concerns and regulations. The final disposal of hazardous waste is typically in a landfill or a geological repository.

Prior to final disposal, the hazardous waste may be chemically or physically modified to improve the stability of the material for long term storage at a disposal site. Chemical preparation can take the form of neutralization, wherein the waste is converted into a nonhazardous form prior to disposal in a landfill or the like, or prior to use in another industrial process. Further, the hazardous waste may also be converted into a more stable chemical form. Typically, the hazardous waste is concentrated, where possible, to reduce the volume of the waste prior to disposal. In the case of hazardous waste in the form of gases and liquids, the waste may be absorbed or converted into a semi-solid or a solid form for ease of containment and to reduce potential problems associated with uncontrolled movement or redistribution of the hazardous waste. The hazardous waste is then placed in a landfill. In cases when the waste is particularly toxic, the waste may be placed within a secondary containment vessel which is in turn placed in a landfill or disposal site. Secondary containment of hazardous waste is of particular importance as it relates to radioactive waste, as the handling and transport of the waste in its uncontained form presents significant health and safety problems.

The development of processes and systems for placement of hazardous wastes into a secondary containment vessel and subsequent storage of the contained waste presents significant problems. In particular, the development of a packaging process is difficult when the hazardous waste remains toxic for an extended period of time, as is the case with radioactive waste. The problems presented by hazardous waste that remains toxic for an extended period of time are twofold; first, the hazards to which the process operators are exposed, and second, the long-term stability of the storage system must be considered. Since the hazardous waste may be toxic to human beings, even upon brief exposure, the containment loading system must be such that it can be operated by individuals wearing protective clothing. In the case of radioactive waste, which may prove fatal to individuals exposed even briefly thereto, the process should be capable of being controlled from a remote site.

Second, in the case of radioactive waste, which may remain toxic for hundreds of years, the long term durability of the containment system is of great importance. The secondary containment system should be such that it is stable under a wide variety of environmental conditions, such as, temperature variations, moisture, and chemical reaction with compounds normally present in the environment.

One process for the containment of spent nuclear fuel involves the electrometallurgical treatment of the fuel, a process which generates a chloride salt of the hazardous waste. The chloride salt is then immobilized within a two-phase composite ceramic that is referred to as a glass-zeolite composite material. The zeolite component of this composite incorporates the waste salt into its crystalline lattice or cage structure. The glass-zeolite material resembles dense polished marble.

Consolidation and secondary containment of the glass-zeolite material can be achieved by the hot isostatic pressing (hereinafter referred to as "HIP") process. In the HIP process, a mixture of glass-zeolite material is loaded into a stainless steel canister by means of uniaxial cold-pressing techniques. Layers of blended powders are successively pressed into the canister until the container is full. Uniaxial pressing is used to compact the powder within the canister to an initial or green density of approximately 40% solids. After the blended powder is loaded into the canister, a cover is welded onto the canister using appropriate welding techniques. The canister cover incorporates a tube used for pre-HIP processing evacuation of the canister.

Next, the loaded canister is then heated to approximately 500° C. (775° K) under a vacuum for approximately 16 hours, to assure the removal of trapped moisture and gases. The canister is then cooled to room temperature. Once cooled, the evacuation tube is crimped and sheared off while the canister is maintained under a vacuum. The vacuum tight crimp may also be welded to insure the tube remains sealed during further HIP processing. The canister is then heated to 1200° C. at pressures up to 175 MPa (1,727 atm) and maintained at that temperature for one to two hours. The canister is then cooled to room temperature. The entire process of chamber evacuation, heat-up, high temperature soaking, and cooling takes place over a period of 20 to 24 hours.

The HIP process, although providing a potential process for consolidating and containing hazardous waste, has a number of deficiencies. The HIP process is designed as a batch process, wherein a single batch of hazardous waste can be sent through the process at one time. The HIP process is difficult to redesign as a continuous process. The process cycle, the period from when the canister is loaded, through degassing, heating and cooling involves a considerable amount of time (approximately one day). It would be desirable to design a process that would provide for continuous operation or semicontinuous operation and a shorter cycle time.

An additional consideration, as with any industrial process, is the level of maintenance necessary to keep the process equipment operational. The quantity of maintenance and the time required to perform the maintenance is dependent on a number of factors; the operating conditions of the process, the physical size of the processing equipment, the amount of material to be processed, and the complexity of the processing equipment. Processing problems arise due to the operating conditions of the HIP process—extreme high temperatures and pressures. The operating pressure during the HIP process cycle, from 1500 to 2000 atmospheres, places a significant amount of mechanical stress on the process equipment and the containment vessel. The operating temperature for the HIP process, on the order of 1200° C., places additional stresses on the process equipment. Due to these extreme operating conditions, maintenance on the equipment is a high priority.

The operating equipment associated with a pilot plant evaluation of the HIP process occupies several cubic meters for equipment to process hazardous waste samples on the order of one to two kilograms. The scale-up of the process equipment to handle commercial size batches of hazardous waste on the order of 25 to 50 kilograms may occupy a space of 10 to 20 cubic meters. Maintenance on the processing equipment of this size would require a significant amount of time due to the size of the equipment. The maintenance period is further increased when the hazardous waste is radioactive thereby requiring special safety precautions during the maintenance cycle.

The last factor, the complexity of the processing equipment, adds significantly to the maintenance cycle in the case of the HIP process. The HIP process requires the use of high efficiency vacuum pumps, high pressure pumps, high temperature heating elements, in addition to sophisticated handling and transport equipment for moving the HIP canister into and out of the processing area. Further, specialized robotic tools may be necessary to weld and crimp and seal the HIP canister. The amount of time required to maintain any of these pieces of process equipment is significant. When these components are brought together in one process the length of time needed to maintain all the components become significant.

The HIP processing time combined with a safe maintenance schedule makes the HIP process unattractive for handling large amounts of hazardous material that is associated with a typical commercial operation.

Thus, the need exists for an efficient process for the consolidation and compaction of solid or semi-solid hazardous waste which provides for the continuous consolidation and compaction of hazardous waste. Preferably, the desired process should require a minimum number of processing steps and be operable at conditions close to standard temperature and pressure. Further, the process should be such that it can be easily controlled and monitored from a remote location. In addition, the process should utilize simple processing equipment that can be easily maintained.

BRIEF SUMMARY OF THE INVENTION

A general object of this invention is to provide a process that can accommodate the continuous compaction and consolidation of hazardous solid waste. A more specific object of this invention is to overcome one or more of the problems described hereinabove.

These and other objects of the invention have been achieved by a novel process for containing solid waste which includes, providing a hollow cylindrical tube and a mixture of solid powdered material, closing one end of the tube, inserting the solid material into the tube, consolidating the solid material by shaking or vibration to and reduce the void volume, and cold working the tube to reduce the diameter and increasing the length of the container, thereby simultaneously compressing the solid material contained therein. The cold working results in an increase in the bulk density of the solid powdered material of from about 1.3 times the initial bulk density to about 2.5 times the initial bulk density. Preferably, the bulk density after cold working is two times that of initial bulk density. The preferred method of cold working is to draw the cylindrical container through a die or a series of dies. The tube may be heated slightly to improve the efficiency of the cold working process.

The cylindrical tube is then capped to provide a sealed cylinder. The tube can be capped or a plug can be inserted into the open end of the tube prior to cold working. The later process step provides for a sealed cylinder for use during the cold working step thereby eliminating the hazards associated with accidental spillage of the waste. With the later approach the plug material should be made from a material and of a size that will deform in the same manner as the cylinder wall. The solid particulate material may also comprise a binder to help fuse the material once it has been compacted.

The sealed container can be further processed by placing it in a heated chamber, heating the cylindrical container to a temperature sufficient to fuse the mixture of hazardous waste contained therein. The closed cylindrical container is then cooled. Preferably, the closed cylindrical container and the hazardous material contained therein is cooled to ambient temperature. The temperature sufficient to fuse the mixture of solid powdered waste is from about 400° C. to about 1500° C. Preferably, the temperature sufficient to fuse the mixture of solid powdered waste is from about 700° C. to about 900° C. The powdered hazardous material for use with this invention should be free-flowing and of a size that can flow into the tube without packing or bridging. Minor packing or bridging which can be corrected by minor mechanical vibration or tapping is acceptable. A suitable particle size is from about 1 micron to about 1 millimeter.

The process of this invention reduces the diameter of the cylinder after cold working from about 50 to 75 percent of the initial diameter. Preferably the diameter of the cylinder is reduced by about 50 percent.

The material from which the cylinder is made can be any ductile material. Preferably the cylinder is made from metal. The metal may be selected from a group consisting of, but not limited to mild steel, stainless steel, Inconel® 600 alloy (15% Cr, 7% Fe, 78% Ni), Hastelloy X® (22% Cr, 19% Fe, 47% Ni, 9% Mo, 1.5% Co) Incoloy 800® (32.5% Ni, 46% Fe, and 21% Cr), tantalum, aluminum, copper, niobium, molybdenum, beryllium, brass and nickel. The material from which the plug is made should be a soft deformable material similar to the material from which the cylinder is constructed. The plug can be made from mild steel, stainless steel, Inconel® 600 alloy, Hastelloy X®, Incoloy 800®, tantalum, aluminum, copper, niobium, molybdenum beryllium, brass and nickel. To improve the chemical resistance of the material from which the tube is made, the tube may be lined with an appropriate material, such as, but not limited to a polymer or organic coating.

This process is for consolidating and containing hazardous waste and in particular radioactive waste. The radioactive waste may be in the form of a powdered phase of a zeolite with an absorbed metal chloride salt and a glass phase.

In the preferred embodiment of this invention, a hollow cylindrical tube having a circular cross-section is provided. The outer wall of the cylindrical tube defines a first diameter. One end of the cylindrical tube is sealed to provide a hollow cylindrical container. A nib or drawing connection may be formed into the sealed end. A mixture of solid powdered waste, having an initial bulk density, and a binder are provided. The mixture of the solid powdered waste and binder is inserted into the hollow cylindrical container thereby filling the container. During the filling operation the mixture in the tube is consolidated by mechanical means such as tapping on the cylinder wall, tamping of the waste material with a rod, or vibration of the cylinder to reduce the void space between the components of the mixture. A plug is inserted into the open end of the cylindrical container to form a closed cylindrical container. The end of the cylindrical container having the drawing nib is inserted into a die having a diameter that is less than the diameter of the cylindrical container. The cylindrical container is drawn though the die thereby reducing the diameter of the cylindrical container, and in turn compressing the powdered mixture. The drawing step may be repeated thereby continuing to reduce the diameter of the closed cylindrical container. The walls of the cylindrical container are compressed around the plug thereby sealing the second end of the cylindrical container while simultaneously increasing the bulk density of the mixture to a second bulk density.

The consolidation process may be continued by placing the closed cylindrical container in a heated chamber and heating the close cylindrical container to a temperature sufficient to fuse the mixture of solid powdered waste. The closed cylindrical container is then cooled to ambient temperature.

The finished product of this compaction and consolidation process is a sealed, uniformly cylindrical sheath surrounding an extremely dense cylinder of stable waste, suited for secondary containment and storage in a repository.

BRIEF DESCRIPTION OF THE SEVERAL VIEWS OF DRAWINGS

With this description of the invention, a detailed description follows with reference being made to the accompanying figures of drawings which form part of the specification, in which like parts are designated by the same reference numbers, and of which:

FIG. 1 is a diagram of the process of this invention illustrating the cold working of a filled cylindrical tube by drawing the tube through a die;

FIGS. 2*a* and 2*b* are diagrams of the process steps forming a drawing tip onto one end of the cylindrical tube;

FIGS. 3*a* and 3*b* are diagrams illustrating the loading of the cylindrical tubes with solid particular hazardous waste;

FIG. 4 is a diagram illustrating the successive draw of a cylindrical tube;

FIGS. 5*a* and 5*b* are cross-sectional views illustrating the difference between the tube diameter prior to being drawn the first time and cross-sectional view of a packed tube after successive drawings;

FIGS. 6*a* is a diagram illustrating a roller furnace; and

FIGS. 6*b* is a diagram illustrating the heat soaking of a bundle of drawn tubes.

The invention is not limited in its application to the details and construction and arrangement of parts illustrated in the accompanying drawings since the invention is capable of other embodiments that are being practiced or carried out in various ways. Also, the phraseology and terminology employed herein are for the purpose of description and not of limitation.

DETAILED DESCRIPTION OF THE INVENTION

Description of the Preferred Embodiment(s)

Figure 1:
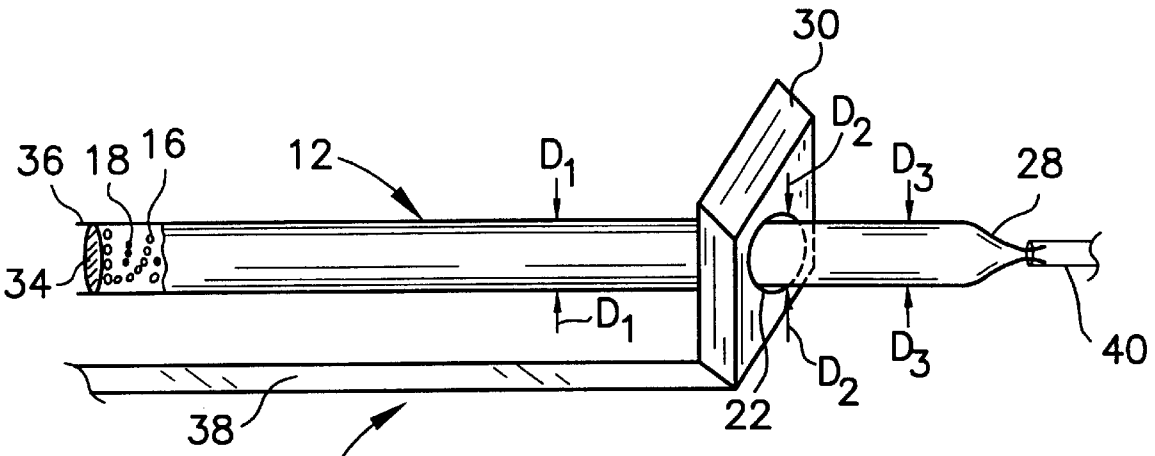

Referring to FIG. 1, the process for containing solid hazardous waste is shown generally at 10. A cylindrical tube 12, having an initial diameter $D_1$, and containing a mixture 14 of solid hazardous waste 16 (light colored particles) and binder 18 (dark colored particles), is cold worked by drawing through a die 20, having an inner opening 22 with a diameter $D_2$, wherein the initial diameter $D_1$ of the cylindrical tube 12 is reduced to a smaller diameter $D_3$ after passing through the die 20. The diameters $D_2$ and $D_3$ are less than $D_1$ ($D_1>D_2$ and $D_1>D_3$). In the process of drawing the cylindrical tube 12 through die 20 the mixture 14 of solid hazardous waste 16 and binder 18 are compacted and compressed. Through successive drawing steps the cylindrical tube 12 and its contents can be compressed to the desired bulk density.

Figure 2A:
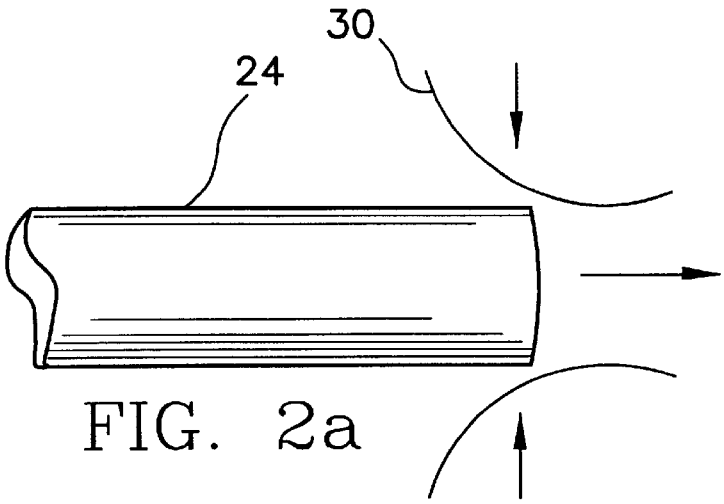
Figure 2B:
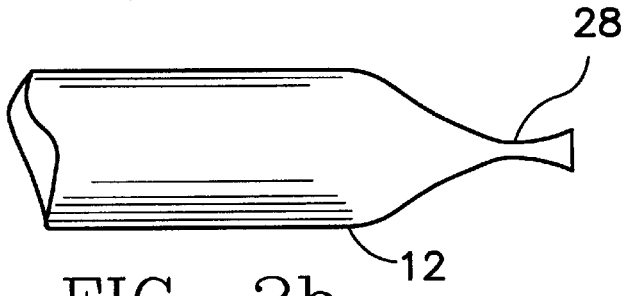

The cylindrical tube 12 for use in the process described hereinabove may be formed as shown in FIGS. 2*a* and 2*b*. An open-ended pipe 24, having an outer diameter $D_1$ as shown in FIG. 2*a* is crimped at one end 26 to form a nib 28 or drawing tip, as shown in FIG. 2*b*, to facilitate the drawing of the finished cylindrical tube 12. The open-ended pipe 24 is crimped by appropriate means, such as with forms 30, as shown in FIG. 2*a*.

Figure 3A:
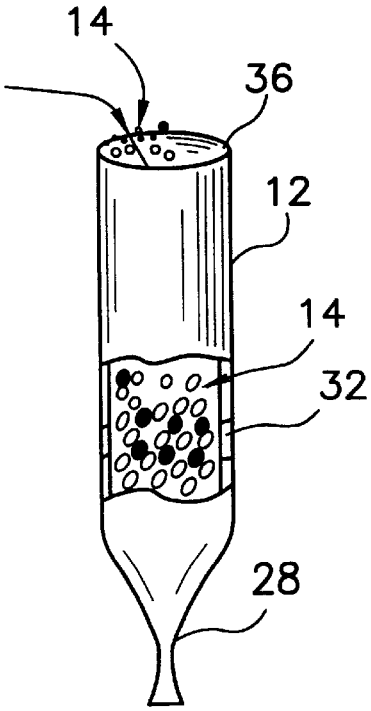
Figure 3B:
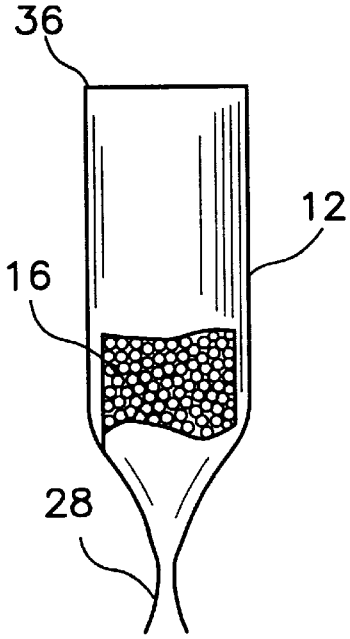

As shown in FIGS. 3*a* and 3*b*, the cylindrical tube 12 is filled with a mixture 14 of solid hazardous waste 16 (light colored particles) and binder 18. When the hazardous solid is of such a consistency as to bind or fuse under pressure without the aid of a separate binder, the hazardous waste may be used alone as shown in FIG. 3*a*. The void volume of the mixture 14 can be reduced by tapping on the wall 32 of the cylindrical tube 12 or by the use of a mechanical shaker or vibrator (not shown). Consolidation of the mixture 14 by tapping or mechanical vibration typically reduces the void volume by 5 to 10 percent.

As used herein, solid is defined as a material that maintains its general shape and form for a period of from about 30 minutes to about 60 minutes when no external force is exerted on the solid. Gels or semi-solid mixtures that retain their shape for a limited time without flowing are considered solids for the purpose of this invention. A solid for this invention is a material that does not flow under normal gravitational forces without a secondary force acting on the material.

After the cylindrical tube 12 is filled, a plug 34 or cap is pressed into the open end 36 of cylindrical tube 12, as shown in FIG. 1. A small hole or port may be formed into the plug to permit the release of entrained gases during heating of the cylinder. The material from which the plug 34 may be made can be any suitable deformable material. When the cylindrical tube 12 is to be subjected to high temperature such that the cylindrical tube must be made out of metal the material from which the plug 34 is formed can be made from copper, aluminum, mild steel, nickel, or antimony. If the cylindrical tube 12 is made from another deformable material, such as a polymer, the same material that is used to fabricate the cylindrical tube 12 may be used as the material for the plug 34. The material from which the plug 34 is made and its thickness should be such that when inserted into the open end 36 of the cylindrical tube 12 and the cylinder is cold worked, that section of the cylindrical tube 12 where the plug 34 is located should not interfere with the drawing step or produce a significant deviation in the surface contour of the cylindrical tube 12.

The cylindrical tube 12 is placed on a support platform 38 adjacent to the die 20. The nib 26 of the cylindrical tube 12 is inserted through the opening 22 in die 20. A drawing chain 40 or cord is attached to the nib 26. The other end of the drawing chain 40 is attached to a drawing motor (not shown). The drawing motor exerts sufficient torque to overcome the resistance of the material from which the cylindrical tube 12 is made and deform the material such that it can be drawn through the die 20. The cylindrical tube 12 is drawn though the die 20 as described hereinabove. The first drawing of the cylindrical tube 12 as shown in FIG. 1 reduces the diameter of the cylindrical tube from $D_1$ to $D_3$ wherein $D_3$ is from about 70 to 85 percent of $D_1$. In turn, the bulk density of the material 12 is increased to 1.3 to 1.5 times the bulk density of the material prior to insertion into the cylindrical tube 12.

Figure 4:
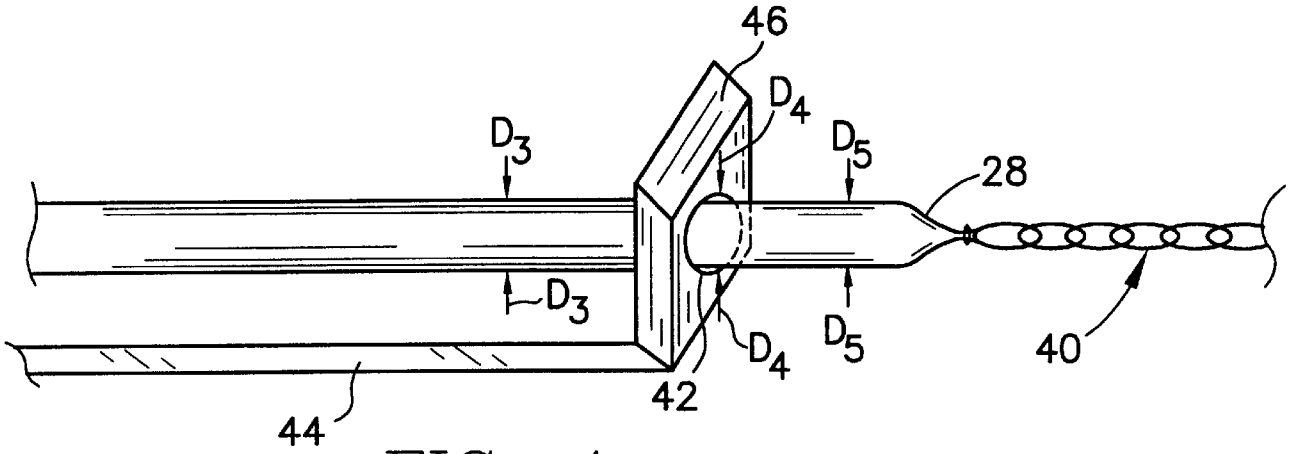

The drawing cycle discussed, hereinabove, may be repeated as needed to increase the bulk density to the desired level. For example, the cylindrical tube 12 is drawn through a second platform 44 and die 46 arrangement as shown in FIG. 4. The cylindrical tube 12 is drawn though opening 48, with a diameter $D_4$, in die 40 further reducing the diameter of the cylindrical tube 12 from $D_3$ to $D_5$. The second and subsequent working of the cylindrical tube 12 as shown in FIG. 4, further reduce the diameter of the cylindrical tube from $D_3$ to $D_5$ wherein $D_5$ is from about 50 to 70 percent of $D_1$. In turn, the bulk density of the material 12 is increased to 1.5 to 1.7 times the bulk density of the material prior to insertion into the cylindrical tube 12.

Reduction of the external diameter from the initial dimensions is preferably obtained by a plurality of drawing steps. The last drawing step preferably reduces the outer diameter of the cylinder 12 by about 50 percent from the initial diameter $D_1$. Particularly good results with respect to uniformity of the cylindrical tube 12 are obtained when the original outer diameter of cylindrical tube 12 is about 1.25 to about 1.5 inches. Preferably, the individual dies through which the cylindrical tube 12 is drawn provides for reduction in cross-section of the cylindrical tube 12 by about 10% for each drawing die.

Figure 5:
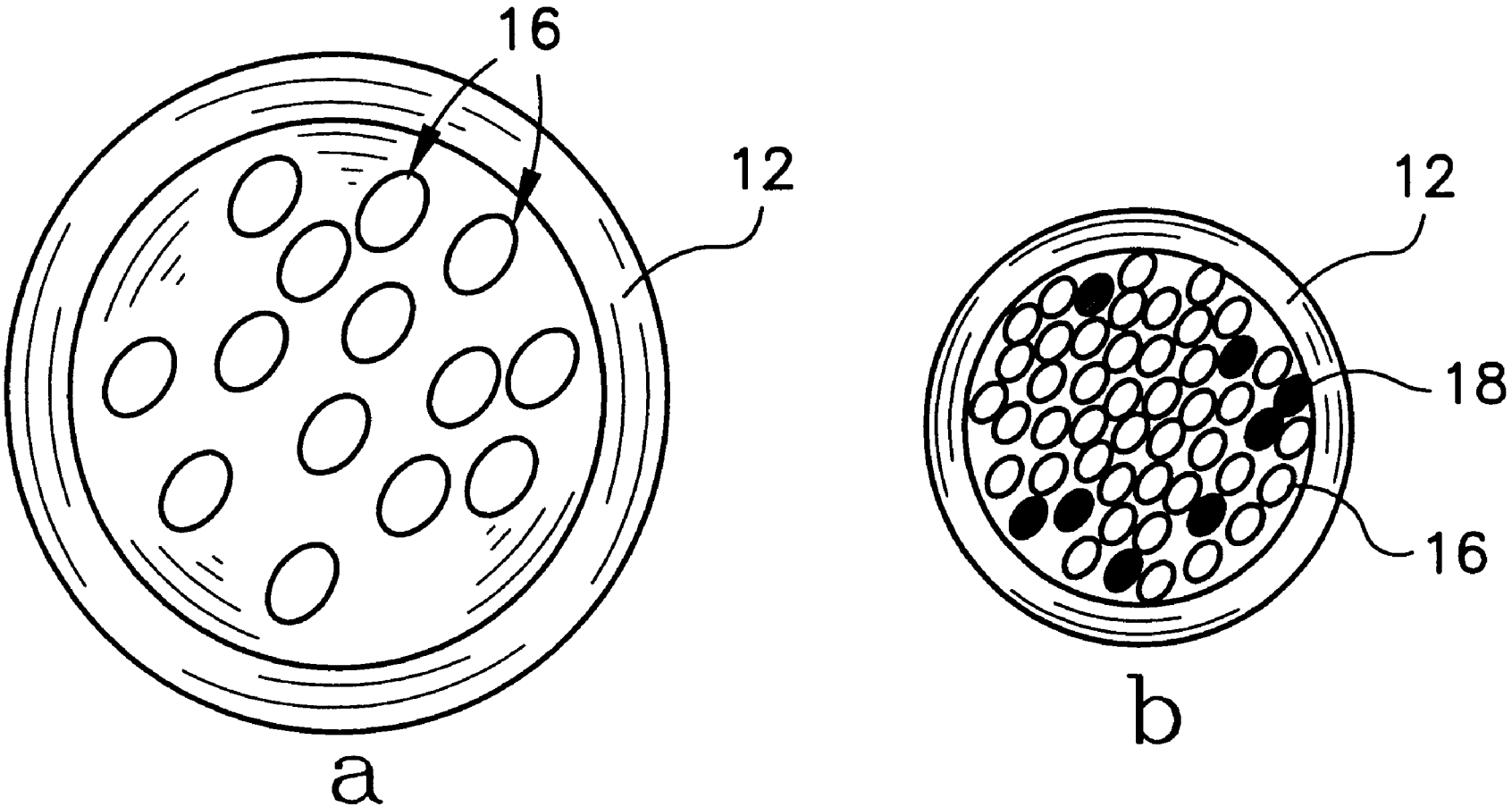

Another way to measure the compression of the mixture 14 is in terms of the theoretical bulk density. The mixture 14 when composed of glass-zeolite material has a theoretical density of 2.35 g/cm$^3$. A quantity of the same mixture in granular or powdered form may have an initial bulk density of from about 35 to about 50 percent of the theoretical density. A sample of the same mixture 14 may have a bulk density from about 50 to about 65 percent of theoretical density when placed in the cylindrical tube 12 and compacted by mechanical vibration, as shown in FIG. 5*a*. A single draw of the cylindrical tube 12 will produce a bulk density of from about 65 to about 75 percent of the theoretical density. Successive drawing of the cylindrical tube 12 containing the mixture 14 will result in a bulk density of the mixture 14 that approaches the theoretical value, for example from about 90 to about 95 percent of theoretical, as shown in FIG. 5*b*. Additional process steps can be performed to bring the bulk density of the mixture to from about 97 to about 99 percent of theoretical density.

Figure 6A:
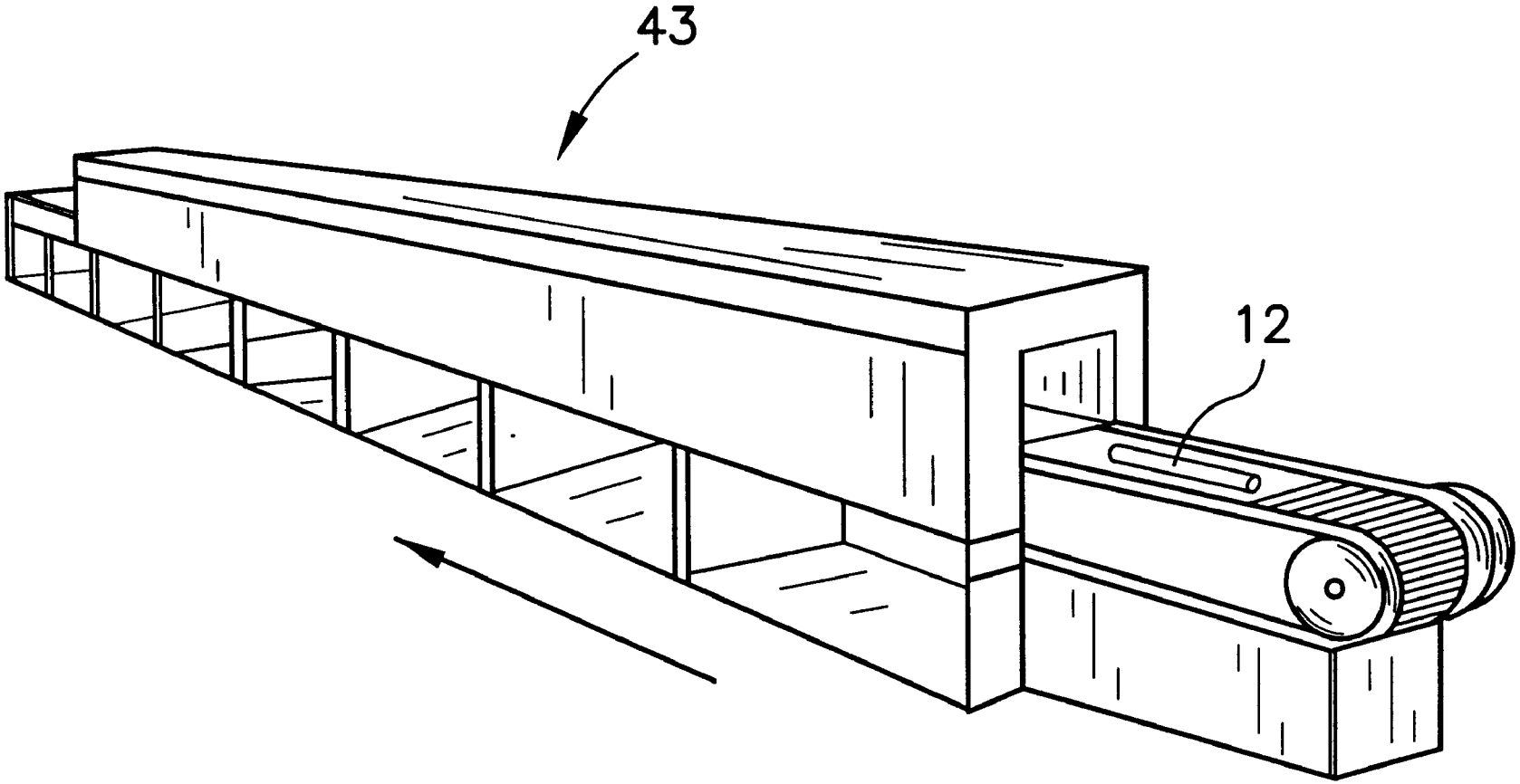
Figure 6B:
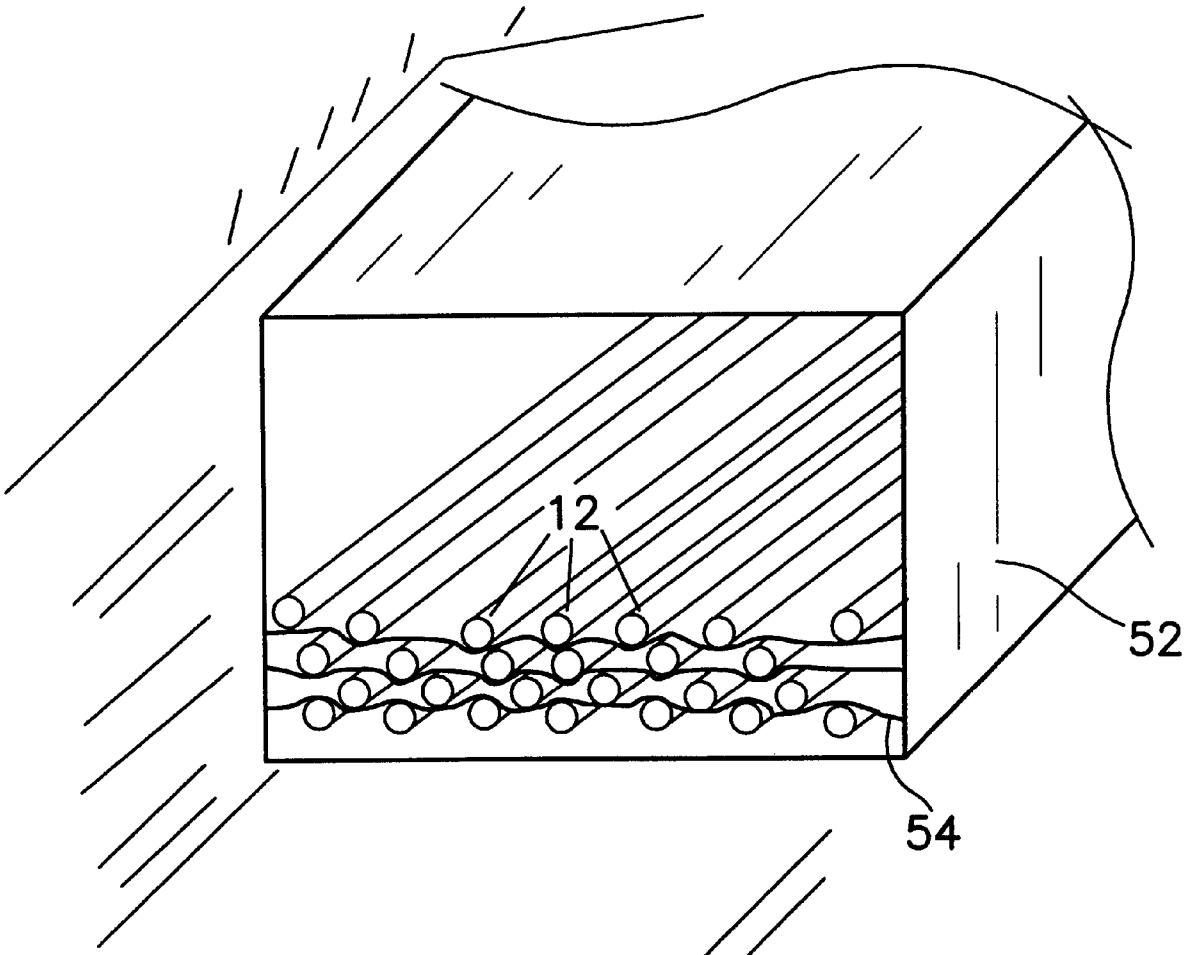

To further increase the bulk density of the mixture 14 within the cylindrical tube 12 can be heated to a temperature sufficient to melt and fuse the components of the mixture 14. When a glass-zeolite material is used as the mixture 14, heating to a temperature from about 500° C. to about 750° C. is sufficient to fuse the glass-zeolite material. Typically, a number of cylindrical tubes 12 are loaded, sealed and drawn as described hereinabove. The cylindrical tubes 12 can than be passed individually through a roller furnace 43, in FIG. 6*a*, that is heated to the appropriate temperature for semicontinuous operation. Alternatively, as a batch operation, as shown in FIG. 6*b*, a number of cylindrical tubes are loaded onto a support and stacked several layers high and then passed through a furnace 52. Spacers 54 may be used between successive layers or groups of layers to permit heat to be transferred to the cylindrical by both radiant and convective means. The cylindrical tubes 12 are then cooled and stored in an appropriate structure.

The tubes and plug material used in the process of this invention may be made from any suitable ductile material that is structurally stable under the process and anticipated storage conditions. Further, the material from which the tubing is made must be stable when placed in contact with the hazardous waste to be stored. When the cylindrical tube is to be drawn and stored without high temperature heating to solidify or fuse the hazardous waste, any suitable material may be used, such as, but not limited to polymers. When high temperature treatment of the cylindrical tube is required, after the drawing of the cylindrical tube, materials such as, but not limited to, mild steel, copper, aluminum, nickel, or stainless steel may be used. Preferably tubing is made from stainless steel such as, but not limited to, 304 stainless steel, 312 stainless, or 316 stainless steel.

The die should be of such construction to provide for the diametric reduction of the cylindrical tube without resulting in the structural degradation of the cylindrical tube. The die should provide a reduction in the diameter of the tube of from about 7 to about 15 percent. Preferably the die provides a reduction of about 10 percent in the diameter of the cylindrical tube.

Examples of process and density Experimental results.

Six sample tubes were prepared to evaluate the process of this invention and the compacted cylinders produced by the process. Each of the nominal one inches outside diameter (1.05 inches O.D.) type 304 stainless steel tubes were swaged at one end to close the tube and form a gripping surface. The swaged end was then clamped and attached to the pulling chain of a drawing mechanism. Non-hazardous zeolite powder with a size range from about 5 to about 20 microns was loaded into the open end of each the tube. The loading of powder into the closed-end tube was done in stages to permit thorough packing and consolidation of the powders. The powders were tamped in the tubes using a steel plunger at the end of each loading stage to increase green (or initial) packing density and to avoid cavity formation. Powders were loaded to within about 1.5 inches from the open end of each tube. The initial void volume ranged from about 50 to about 70% depending on relative packing aggressiveness and powder morphologies. This void volume corresponds to an initial bulk density of from about 0.7 g/cm$^3$ to about 1.18 g/cm$^3$. Plugs were then inserted into the open ends of each of the tubes to confine the powder. Both plastic and metallic plugs were used to seal the loading end of each tube. The tubes were drawn to the desired final diameter through successive drawing steps. The tubes were not annealed in order to preserve the powders' phase assemblage.

Tubes were drawn 2–4 times with outer diameter reductions of about 25% per draw. In general, tubes drawn too few times gave less than desired packed densities (pre-sintering) and tubes drawn too much showed cracked or cracking stainless steel sheaths. Matching of degree of drawing or equivalently degree of volume reduction to the green density of the powder loading was shown to be essential.

Sintering of appropriately drawn specimens was done at temperatures ranging for 750° C. to 850° C. Fully dense, uniform ceramic composites were successfully manufactured.

Thus, in accordance with the invention, there has been provided a process that can accommodate the continuous compaction and consolidation of hazardous solid waste. Further, there has also been provided to overcome one or more of the problems described.

With this description of the invention in detail, those skilled in the art will appreciate that modification may be made to the invention without departing form the spirit thereof. Therefore, it is not intended that the scope of the invention be limited to the specific embodiments that have been illustrated and described. Rather, it is intended that the scope to the invention be determined by the scope of the appended claims.

We claim:

1. A process for containing solid waste comprising:

a) providing a hollow cylindrical tube having a circular cross-section and an outer wall defining a first diameter, a first end and a second end, wherein the first end is sealed to provide a hollow cylindrical container;

b) providing a mixture of solid waste, said mixture having a first bulk density;

c) inserting said mixture of said solid waste into said hollow cylindrical container and filling said hollow cylindrical container;

d) consolidating said mixture in said hollow cylindrical container to reduce the void space between the components of said mixture; and e) pulling said cylindrical container through a circular opening in a die to reduce the diameter of said cylindrical container to a second diameter to form a compacted cylindrical container while simultaneously increasing the bulk density of said mixture from an initial bulk density to a second bulk density and maintaining the circular cross-section of the cylindrical container.

2. The process for containing solid waste of claim 1 wherein the solid waste is in the form of a powder.

3. The process for containing solid waste of claim 1 wherein a plug is inserted into the second end of said cylindrical container to form a closed cylindrical container prior to cold working of the cylinder.

4. The process for containing solid waste of claim 3 wherein the material from which the plug is made is a soft ductile metal.

5. The process for containing solid waste of claim 4 wherein the material from which the plug is made is selected from the group consisting of mild steel, stainless steel, Inconel alloy, Hastelloy X, Incloy 800, tantalum, aluminum, copper, niobium, molybdenum, beryllium, brass and nickel.

6. The process for containing solid waste of claim 1 wherein the solid waste further comprises a binder.

7. The process for containing solid waste of claim 6 whereby the second diameter is about 50 percent of the first diameter.

8. The process for containing solid waste of claim 1 wherein the second diameter is from about 50 to 75 percent of the first diameter.

9. The process for containing solid waste of claim 1 wherein the material from which the cylinder wall is made of a metal.

10. The process for containing solid waste of claim 9 wherein the metal is selected from the group consisting of mild steel, stainless steel, Inconel alloy, Hastelloy X, Incloy 800, tantalum, aluminum, copper, niobium, molybdenum, beryllium, brass and nickel.

11. The process for containing solid waste of claim 1 wherein the solid waste is radioactive.

12. The process for containing solid waste of claim 11 wherein the solid radioactive waste comprises a mixture of a crystalline phase of a zeolite with an absorbed metal chloride salt and a glass phase.

13. The process of containing solid waste of claim 1 further comprising the steps of:

g) placing said compacted cylindrical container in a heated chamber;

j) heating said compacted cylindrical container to a temperature to fuse the mixture of solid waste; and k) cooling said closed cylindrical container.

14. The process of containing solid waste of claim 13 wherein the temperature sufficient to fuse the mixture of solid waste is from about 400° C. to about 1500° C.

15. The process of containing solid waste of claim 13 wherein the temperature sufficient to fuse the mixture of solid waste is from about 1000° C. to about 1250° C.

16. The process of containing solid waste of claim 1 wherein said second bulk density is 2 times that of said first bulk density.

17. A process for containing solid waste comprising:

a) providing a hollow cylindrical tube having a circular cross-section, an outer wall defining a first diameter, a first end and a second end, wherein the first end is sealed to provide a hollow cylindrical container;

b) providing a mixture of powdered solid waste and a binder, said mixture having a first bulk density;

c) inserting said mixture of said powdered solid waste and binder into said hollow cylindrical container and filling said hollow cylindrical container;

d) consolidating said mixture in said hollow cylindrical container to reduce the void space between the components of said mixture;

e) inserting a plug into the second end of said cylindrical container to form a closed cylindrical container;

f) inserting the first end of said cylindrical container into a die having a second circular diameter that is less than the first diameter of said cylindrical container;

g) drawing said cylindrical container though said die thereby reducing the diameter of the cylinder container to a third diameter, thereby compressing said mixture;

h) repeating steps f and g thereby continuing to reduce the diameter of the closed cylindrical container to a forth diameter thereby compressing the wall of the cylindrical container around the plug thereby sealing said second end of said cylindrical container and increasing the bulk density of said mixture to a second bulk density.

18. The process of containing solid waste of claim 17 further comprising the steps of:

i) placing said closed cylindrical container in a heated chamber;

j) heating said close cylindrical container to a temperature sufficient to fuse the mixture of solid waste; and k) cooling said closed cylindrical container to ambient temperature.

19. The process of claim 1 further comprising sealing the second end of the cylindrical container to provide a closed container.

* * * * *